US010723593B2

(12) United States Patent
Saarela et al.

(10) Patent No.: US 10,723,593 B2
(45) Date of Patent: Jul. 28, 2020

(54) IMPACT DETECTION IN AN ELEVATOR DOOR

(71) Applicant: KONE Corporation, Helsinki (FI)

(72) Inventors: Sami Saarela, Helsinki (FI); Antti Raiko, Helsinki (FI); Mika Lehtonen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 455 days.

(21) Appl. No.: 15/638,890

(22) Filed: Jun. 30, 2017

(65) Prior Publication Data

US 2018/0086605 A1 Mar. 29, 2018

(30) Foreign Application Priority Data

Sep. 26, 2016 (EP) ..... 16190619

(51) Int. Cl.

| | |
|---|---|
| ***B66B 13/24*** | (2006.01) |
| ***B66B 13/22*** | (2006.01) |
| ***B66B 5/00*** | (2006.01) |
| ***B66B 5/02*** | (2006.01) |

(52) U.S. Cl.

CPC ..... *B66B 13/24* (2013.01); *B66B 5/0025* (2013.01); *B66B 5/0031* (2013.01); *B66B 5/02* (2013.01); *B66B 13/22* (2013.01)

(58) Field of Classification Search

CPC ..... B66B 13/24; B66B 5/0025; B66B 5/0031
USPC ..... 187/393
See application file for complete search history.

(56) References Cited

U.S. PATENT DOCUMENTS

| | | | | |
|---|---|---|---|---|
| 6,863,161 | B2 * | 3/2005 | Mearns | B66B 5/0006 187/247 |
| 8,028,807 | B2 * | 10/2011 | Deplazes | B66B 5/0025 187/391 |
| 9,586,790 | B2 * | 3/2017 | Tyni | B66B 5/0006 |
| 2006/0124399 | A1 * | 6/2006 | Kugiya | B66B 5/06 187/295 |
| 2009/0101450 | A1 * | 4/2009 | Kugiya | B66B 5/06 187/305 |
| 2011/0290591 | A1 * | 12/2011 | Spirgi | B66B 5/0087 187/247 |
| 2012/0283870 | A1 * | 11/2012 | Senger | B66B 29/005 700/230 |

(Continued)

FOREIGN PATENT DOCUMENTS

| | | | |
|---|---|---|---|
| EP | 0 776 855 | A1 | 6/1997 |
| WO | WO 2008/081074 | A1 | 7/2008 |
| WO | WO 2013/145144 | A1 | 10/2013 |

OTHER PUBLICATIONS

Search Report for European Patent Application No. 16190619.3, dated Mar. 17, 2017.

*Primary Examiner* — David S Warren
(74) *Attorney, Agent, or Firm* — Birch, Stewart, Kolasch & Birch, LLP

(57) ABSTRACT

The disclosure relates to a method for detecting an impact on an elevator door. The method is characterized in that it comprises detecting a break in an elevator door safety circuit; comparing characteristics of the break to a set of parameters; and performing an action when the characteristics of the break fulfil the conditions determined by the set of parameters. The disclosure further relates to an apparatus, to an elevator safety system and to an elevator.

20 Claims, 2 Drawing Sheets

(56) References Cited

U.S. PATENT DOCUMENTS

| | | | | |
|---|---|---|---|---|
| 2014/0008152 | A1* | 1/2014 | Annen | B66B 5/0037 187/247 |
| 2016/0009526 | A1* | 1/2016 | Mertala | B66B 13/22 187/288 |
| 2016/0185569 | A1* | 6/2016 | Sonnenmoser | B66B 5/0025 187/393 |
| 2017/0334682 | A1* | 11/2017 | Hanninen | B66B 11/0226 |
| 2018/0086605 | A1* | 3/2018 | Saarela | B66B 5/0031 |
| 2018/0215578 | A1* | 8/2018 | Kusserow | B66B 5/0031 |
| 2018/0282111 | A1* | 10/2018 | Kattainen | H04L 1/0061 |
| 2018/0329848 | A1* | 11/2018 | Kattainen | B66B 1/3461 |
| 2019/0002238 | A1* | 1/2019 | Bogli | B66B 5/0025 |
| 2019/0010022 | A1* | 1/2019 | Trcka | B66B 5/0025 |
| 2019/0100412 | A1* | 4/2019 | Han | B66B 13/143 |
| 2019/0177114 | A1* | 6/2019 | Fargo | B66B 1/32 |
| 2019/0193986 | A1* | 6/2019 | Studer | B66B 1/3492 |
| 2019/0193992 | A1* | 6/2019 | Studer | B66B 5/0025 |

* cited by examiner

IMPACT DETECTION IN AN ELEVATOR DOOR

TECHNICAL FIELD

The present disclosure relates to a method for detecting an impact on an elevator door, to an elevator safety mode and to an apparatus for detecting an impact on an elevator door. The present disclosure further relates to an elevator door safety system and to an elevator.

BACKGROUND ART

Elevator doors are frequently objects of different types of impacts, intentional and unintentional alike. The doors may be accidentally rammed against by trolleys, heavy equipment, such as forklifts, etc. In some locations, elevator doors may be vandalized by kicking and throwing objects at them. As a consequence of various impacts, the door panels may bend, or in the worst case, be completely knocked off the door sill.

Currently, there is no reliable method for monitoring impacts, or damage in door components caused by them. This may present a safety hazard, since in the absence of a warning system, the elevator car continues to operate normally. If the doors are damaged to an extent preventing them from working properly, there is a risk of further damage to the door components, when the door operator tries to operate the doors as usual. Even worse, in case the doors are detached from the sill, the dislocated parts may hit other components during elevator car movement. In the case of elevator car door panels, the loose car door panels may hit shaft components. Loose landing door panels may be hit by the elevator car moving at full speed, potentially causing severe damage to elevator components or passengers. Further, damaged landing doors may contain the danger of people falling into the elevator shaft.

Currently, the main impact detection method relies on the disruption of an elevator safety chain, which stops the elevator movement completely. Also elevator users report malfunctions. The drawbacks of the current systems are that some malfunctions that do not lead to the discontinuation of the safety circuit may remain undetected. The inventors have thus recognized the need for an improved detection method for impacts directed at elevator door panels, in order to further improve the reliability of elevator function and user safety.

SUMMARY

An object of the present disclosure is to alleviate the problems related to prior art. It is especially the object of the present disclosure to provide a method, an apparatus and an elevator that allow the detection of impacts of different intensities on elevator door panels.

The method and the apparatus according to the present disclosure are in particular, but not only, intended for elevators, especially for passenger or cargo elevators of buildings.

The method according to the present disclosure is characterized by what is presented in claim 1.

The elevator safety mode according to the present disclosure is characterized by what is presented in claim 9.

An apparatus according to the present disclosure is characterized by what is presented in claim 10.

An elevator door safety system according to the present disclosure is characterized by what is presented in claim 11.

An elevator according to the present disclosure is characterized by what is presented in claims 12 and 13.

The inventors have surprisingly found out that an impact on a door panel may be detected through a transient break in the elevator safety circuit. The break typically remains below the threshold value set for a safety circuit to halt the movement of the elevator car.

The method, the elevator safety mode, the apparatus, the elevator door safety system and the elevator according to the present disclosure may offer at least one of the following advantages over prior art.

Impacts which do not lead to the permanent disruption of an elevator safety circuit may be detected and interpreted as signs of impacts on door panels. This may allow the instantaneous recognition of potential door damage, as well as the prompt adjustment of elevator function accordingly. This in turn may reduce damage caused by impacts on door components, as the elevator function may be adjusted to take potential damage into account by, for example initiation of a safety mode and/or door operation self-check and/or reduction of operating speed.

This, again, may reduce the need for maintenance visit and the costs involved in repairing damaged door components.

A further advantage may be the increased safety of the elevator to users of the elevator and/or the building in which the elevator is located.

BRIEF DESCRIPTION OF DRAWINGS

The accompanying drawings, which are included to provide a further understanding of the disclosure and constitute a part of this specification, illustrate embodiments and together with the description help to explain the principles of the disclosure but the disclosure is not limited to the specific embodiments illustrated in the drawings. In the drawings.

DETAILED DESCRIPTION

Figure 1:
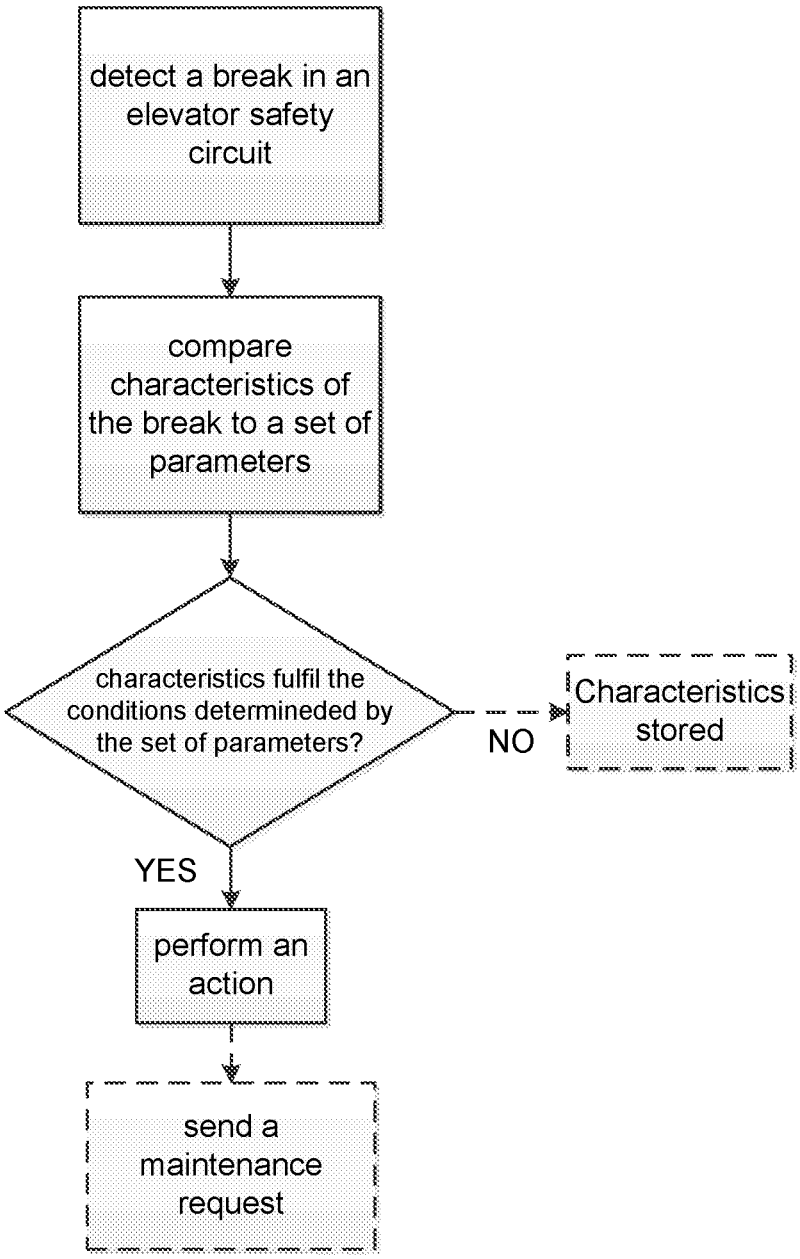
FIG. 1 is a flow chart of an embodiment of the method according to the present disclosure.

Elevators commonly contain safety circuits. Their purpose is to prevent the operation of an elevator that may have faults or defects potentially causing safety hazards. Different safety circuits monitor different aspects of elevator function. For example, both elevator car doors and elevator landing doors are equipped with safety circuits that are configured to monitor that doors are closed when the elevator car moves. There may be one or more safety circuits in parallel monitoring a given functional aspect of the elevator.

A safety circuit comprises at least one safety switch. In case there are two or more safety switches in a safety circuit, the switches may be serially connected. Thus, if one safety switch is open, or signals open position of the door lock, there is a break in the safety circuit, and the movement of the elevator car is prevented and/or other safety measures are taken. In practice, safety codes require that the safety switch opens, or signals open position of the door lock, already before the door lock physically opens. Therefore, in the current disclosure, by an open position of the door lock is meant a door lock-related event that causes the opening of the safety switch, or the signaling of the open position of the door lock by the safety switch, even if the door lock does not physically open.

The safety switches can be implemented using various techniques that are known in the art. For example, in serial bus-type safety circuit, the safety switches may be connected in parallel. Typically, the safety circuit utilizes an electric signal, or a combination of an electric signal and a wireless signal. The safety circuit may be relay-based. The safety circuit may be monitored by a controller for integrating and/or filtering the information provided by the safety circuit. The controller may control the elevator car movement based on said information. The controller may be arranged as a safety controller, or it may be any other type of a device integrating and/or filtering the information provided by the safety circuit.

The elevator door safety circuit typically monitors both that the door panels are in a closed position, and that the door lock is closed.

In the current method, a break in an elevator door safety circuit is used to detect an impact on one or more door panels. When a heavy enough impact is directed at a door panel, the door panel makes a slight jump, temporarily opening a door safety switch, or causing it to signal open position of the door lock. This leads to a break in the elevator door safety circuit. If the impact is hard enough, the door panel may make two jumps, causing two breaks in the safety circuit within a short time. The door panel may be a landing door panel or an elevator car door panel.

In one aspect, a method for detecting an impact on an elevator door is disclosed. The method is characterized in that it comprises detecting a break in an elevator door safety circuit;

comparing characteristics of the break to a set of parameters; and performing an action when the characteristics of the break fulfil the conditions determined by the set of parameters.

In the method, first a break in the door safety circuit is detected. In one embodiment, the elevator door safety circuit is an elevator car door safety circuit or an elevator landing door safety circuit. In many elevators, both the landing doors and the elevator car doors are monitored by a safety circuit. The current method may be implemented in both the elevator car door and in the landing doors. Alternatively the current method may be implemented only for the landing doors or in elevator car door.

The break may be detected in one or more safety circuits. In one embodiment, detecting the break comprises recording the landing level on which the break occurs. If the safety circuit monitors the landing doors, the landing door safety switches need to be arranged in a way that allows the detection of a break in each landing individually. Such an arrangement may offer benefits, as the accurate positioning of the potential impact simplifies the analysis of the possible impact situation afterwards, and the elevator car is easier to configure to avoid such a floor. Further, only the landing on which the impact was detected may be checked for door functionality. Additionally, if impacts tend to concentrate on one or some landings, this may be useful information for the building administrator, since such concentration might be indicative of disturbances or other problems on the affected floors.

Elevator car doors are typically monitored by a safety circuit separate from that of the landing doors. Thus, impact on the elevator car doors is discernible from those of the landing doors.

Next, the characteristics of the break are compared to a set of parameters to evaluate if an action needs to be performed. If the characteristics of the break fulfil the conditions determined by the set of parameters, an action is performed.

By the characteristics of the break is herein meant different aspects of the break that may be of use in determining if the break in the safety circuit was caused by an impact on the door, or by another factor. In one embodiment, the characteristics of the break comprises duration of the break and/or the time lapsed after a previous break, and/or the position and movement speed of an elevator car at the time of the occurrence of the break.

By the set of parameters to which the characteristics of the break are compared, is herein meant one or more threshold values for each characteristic of the break which correlates with the break being caused by an impact on the door. Often, a parameter contains an upper threshold and a lower threshold. Depending on the characteristic, it may, however, contain only an upper threshold value or a lower threshold value. One or more characteristics may be used in the set of parameters. Each characteristic may function either by promoting the interpretation of the break as having been caused by an impact on the door, or by depressing such interpretation. Different values of each characteristic may be interpreted in opposite directions.

For example, if the duration of the break exceeds a threshold value, it is deemed not to have been caused by an impact on the door. Such a threshold value may be, for example, 500 ms. Similarly, if a break occurs within a given time from a previous break, it may be interpreted as being caused by a strong impact on the door that has made the door panel jump twice.

Further, if the position and movement information of the elevator car is integrated with the locality information of breaks in the safety circuit, it is possible to exclude door panel jumps that are caused by an elevator car passing the landing on which the break in the safety circuit was detected. In one embodiment, the position and/or movement speed of the elevator car is recorded and, if the elevator car passes the landing level on which the break occurs within a predetermined time of the break and/or with a pre-determined speed, the break is disregarded.

The elevator car moving in the elevator shaft causes a so-called piston effect, when air is pushed by the elevator car, and forced to move ahead of the elevator car and is squeezed between the elevator car and the shaft walls. Also air currents are formed behind the elevator car. This may sometimes cause landing door swaying, as the air pressure in the shaft changes rapidly. This may cause similar jumping of the landing door panels as impacts from the landing side. The movement and/or speed information of the elevator car may be used to differentiate between the two phenomena. The changes in pressure and their timing relative to the elevator car passing a given landing depend on the specifics of the elevator installation. Therefore, said time and/or speed parameters need to be determined individually for each elevator, or elevator configuration.

In cases where the break in the door safety circuit is deemed to have been caused by other factors than by an impact on the door, the break may be utilized in determining the presence of other door safety-related issues.

Next, if the conditions determined by the set of parameters are fulfilled by the break, an action is performed. In one embodiment, the action comprises initiation of an elevator safety mode and/or the action comprises testing of at least one door-related parameter for evaluating elevator door functionality. Thus, an elevator safety mode may be initiated. Alternatively or in addition, at least one door-related parameter may be tested. The door-related parameter may be, for example, door motor current during the movement of a door panel, door panel movement speed with a given door motor current or other measurable door feature that might be indicative of door condition. If the door on which the impact was detected is specified, only that door may be tested. If, for example, the safety circuit cannot identify individual landing doors, it may be necessary to test the at least one door-related parameter for all landing doors.

Alternatively, the action might be, for example, reducing the movement speed of the elevator car, halting the movement of the elevator car, sending a warning signal to an elevator control center, and/or triggering an alarm, potentially on the landing on which the impact was detected.

The method may comprise further steps. In one embodiment, the method comprises sending a maintenance request if the action is performed. If the comparison of the characteristics of the break to a set of parameters according to the present disclosure results in the determination of an impact, which again leads to performing an action, it might be beneficial to send a maintenance request. The sending of a maintenance request may be conditional on finding irregularities in the door function in subsequent diagnostic program, such as testing at least one door-related parameter. Information on the characteristics of the detected break in the elevator safety circuit may be provided together with the maintenance request.

Additionally or alternatively, the characteristics of the break in the elevator safety circuit may be sent to a remote location, such as an elevator control center. The information provided by an elevator, or a number of elevators may be used centrally to analyze the occurrence of breaks, and/or to further develop the parameters used in the current method.

Further, if a door-related parameter is found to be unacceptable, the method may comprise halting the elevator car on a landing on which such a door-related parameter was detected. The optional sending of a maintenance request maybe conditional on halting the elevator car on a landing.

The method according to the current disclosure may be developed in each elevator installation independently. If the performed action comprises a diagnostic program that tests the door functionality after an impact has been detected, it is possible to compare the characteristics of the break that led to the performance of the action to the findings of such diagnostic program. If a door malfunction is detected, it can be deduced that the presence of the impact was correctly interpreted. However, if certain characteristic values repeatedly trigger the performance of the action according to the present disclosure, but do not lead to any detectable door malfunctions, such characteristic values may be, for example, excluded from the set of parameters used in the current method.

In one embodiment, the method further comprises storing the characteristics of the break detected in the elevator door safety circuit; analyzing the necessity of the performed action; and adjusting the set of parameters. By performing such an analysis, it is possible to improve the reliability of impact detection for those incidents that are likely to damage the elevator doors. The hardness of the impact and its effect on the jumping of the door panel might vary according to the elevator specifics. Thus, the initial set of parameters used for impact detection might benefit from further adjustment.

In one aspect, an elevator safety mode is disclosed. The elevator safety mode is characterized in that it is initiated by detecting an impact by the method according to the current disclosure. The elevator safety mode may comprise, for example, reducing the movement speed of the elevator car to decrease the effects of the elevator car colliding with loose or deformed door components. If the impact is detected in the elevator car doors, the reduction in movement speed may help protect the elevator shaft components, if the elevator car doors are affected.

Alternatively or in addition, the elevator safety mode may comprise driving the elevator car to the landing nearest to the elevator car at the time of impact detection for allowing the passengers to exit the elevator car. This may be accompanied by informing the passengers that they should exit the elevator car. Further, the elevator safety mode may comprise testing that the elevator car is empty before the elevator car moves further.

It is also possible that the elevator safety mode according to the present disclosure comprises testing a pre-determined door-related parameter at one or more landings to evaluate door functionality. If a door-related parameter is found to be unacceptable, the elevator car may be halted on the landing on which such a door-related parameter was detected.

As examples, the following embodiments of the elevator safety mode according to the present disclosure may be described.

When the landing door in which the break in the safety circuit is detected is not specified, the elevator safety mode may comprise the following features. The movement speed of an elevator car is reduced when an impact is detected, then the elevator car is driven to the landing nearest to the elevator car at the time of impact detection for allowing the passengers to exit the elevator car. The safety mode may further comprise testing a pre-determined door-related parameter at a landing to evaluate door functionality. If the pre-determined door-related parameter is within a range deemed acceptable, the elevator car is driven to a next landing at a reduced speed. If the door-related parameter is deemed non-acceptable, the elevator car is held at the landing on which the non-acceptable door-related parameter was observed.

The testing of the door-related parameter and driving the elevator car to the next landing is repeated for all landings, or until a pre-determined door-related parameter is deemed non-acceptable. If all the pre-determined door-related parameters are within a range deemed acceptable, the normal functioning of the elevator may be resumed. If a door-related parameter is deemed non-acceptable, a maintenance request may optionally be sent.

When the landing door in which the break in the safety circuit is detected is specified, the elevator safety mode may comprise the following features. The movement speed of an elevator car is reduced when an impact is detected. Then, the elevator car is driven to the landing nearest to the elevator car at the time of impact detection for allowing the passengers to exit the elevator car. Since the landing on which the impact was detected is known, the elevator car may be driven to a different landing than the one on which the impact was detected. Then, the elevator car may be driven to the landing on which the impact was detected at a reduced speed and a pre-determined door-related parameter may be tested to ascertain door functionality. If the pre-determined door-related parameter is within a range deemed acceptable, the normal functioning of the elevator may be resumed. Alternatively, if at least one of the pre-determined parameters is deemed non-acceptable, the elevator car may be held at the landing on which the impact was detected. Optionally a maintenance request may be sent.

In another aspect, an apparatus for detecting an impact on an elevator door is disclosed. The apparatus is characterized in that it is configured to perform the method according to the current disclosure. Thus, the method according to the present disclosure may be implemented as a computer program. The computer program is configured to perform the method when executed in a computing device. The apparatus may be located in the elevator installation or it may be located remotely, for example in an elevator service center. The elevator service center may be specific for a given elevator installation, to a given building, or for a number of elevator installations and/or buildings. It may thus be externally located and connected to the elevator through a communication link or network. The apparatus according to the present disclosure may comprise a safety controller. Alternatively, the apparatus may be comprised in a safety controller.

In yet another aspect, an elevator door safety system is disclosed. The elevator door safety system is characterized in that it is configured to perform the method according to the current disclosure. The elevator door safety system comprises the hardware and software necessary for implementing the safety procedures relating to the elevator doors. It comprises the safety circuits, and the relevant controllers, as well as connections to the devices regulating elevator car movement. Further, the elevator door safety system may comprise the elevator door locks and the appropriate monitoring devices for detecting whether the door is closed.

In yet another aspect, an elevator is disclosed. The elevator is characterized in that it is configured to perform the method according to the current disclosure. The elevator may alternatively or in addition comprise an elevator safety system and/or an apparatus according to the present disclosure.

In another aspect of an elevator according to the current disclosure, the elevator is characterized in that it is configured to run the elevator safety mode according to the current disclosure.

An elevator according to the present disclosure comprises an elevator car comprising an elevator car door, and at least two landing levels on which passenger and/or cargo may be loaded or unloaded. The landings comprise landing doors.

DESCRIPTION OF DRAWINGS

The following figures are to be understood as exemplary embodiments of the present disclosure. Further embodiments of the disclosure are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described below may also be employed without departing from the scope of the invention, which is defined in the accompanying claims.

All parts in the figures are depicted only schematically and their sizes are not drawn proportionally. Further, all additional elevator components are omitted from the figures, although some of them might be present.

FIG. 1 is a flow chart of an embodiment of the method according to the present disclosure. In the embodiment of FIG. 1, a break is detected in an elevator safety circuit. The characteristics of the break are then compared to a set of parameters. If the characteristics of the break fulfil conditions determined by the set of parameters, an action is performed. The action may be, for example, the initiation of an elevator safety mode. Optionally, a maintenance request may be sent if an action is performed. Thus, performing an action triggers the sending of a maintenance request. In such a case, if there are multiple actions from which one is selected based on the characteristics of the break, information on the action may be sent together with the maintenance request. The optionality of sending the maintenance request is indicated by dashed outline in FIG. 1.

Alternatively, sending a maintenance request could be an action performed if the characteristics of the break fulfil conditions determined by the set of parameters. Thus, one or more actions could be performed if the characteristics of the break fulfil conditions determined by the set of parameters. As an example, a first action could be the initiation of an elevator safety mode and a second action could be sending of a maintenance request.

If the characteristics of the break do not fulfil the conditions determined by the set of parameters the elevator continues to function normally. However, the characteristics of the break may optionally be stored, since they may be of value in the further development of the method according to the present disclosure, or as an indication of other issues with the elevator. The optionality of storing the characteristics of the break is indicated by dashed outline in FIG. 1.

Figure 2:
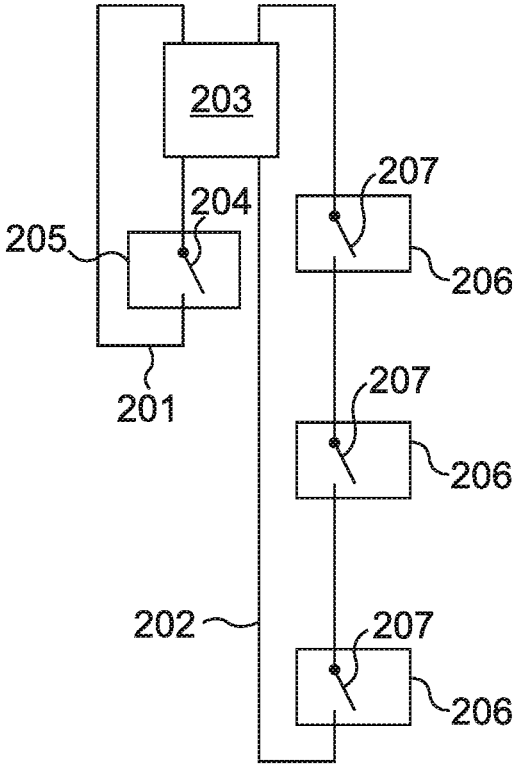
FIG. 2 is a block diagram of an exemplary embodiment according to the present disclosure.

FIG. 2 is a block diagram of an exemplary embodiment according to the present disclosure. In the embodiment of FIG. 2, there are two safety circuits, an elevator car door safety circuit 201 and a landing door safety circuit 202. The two safety circuits 201 and 202 are connected to a common controller 203. Alternatively, each safety circuit could have its own controller 203, the two of which could be connected to another controlling device. This controlling device could be any elevator control and monitoring unit.

The elevator car may move only when both the elevator car safety circuit 201 and the landing door safety circuit 202 have a closed status. If a break in a safety circuit is detected, the method according to the present disclosure is implemented and if the characteristics of the break fulfil the conditions of the set of parameters, action according to the present disclosure is performed.

The elevator car door safety circuit 201 comprises a safety switch 204, which monitors the open and closed position of an elevator car door lock 205. When the elevator car door lock 205 is in an open position, the safety switch 204 is open, or signals open position of the door lock 205, creating a break in the safety circuit 201. When the elevator car door lock 205 is closed, the safety switch 204 is closed, or signals closed position of the door lock 205, which again leads to closed status of the safety circuit 201.

Similarly, the landing door safety circuit 202 comprises a landing door safety switch 207 for each landing door lock 206. In the embodiment of FIG. 2, there are three landing doors, one in each landing (represented by the vertical positioning of the landing door locks 206 in FIG. 2). When any of the landing door locks 206 is in an open position, the corresponding safety switch 207 is open, or signals the open position of the landing door lock 206, creating a break in the safety circuit 202. When all the landing door locks 206 are closed, all the safety switches 207 are closed, or signal a closed position, leading to closed status of the safety circuit 202.

It would be possible for each landing to have more than one door, for example two doors opposing each other. In such a case, there could be one common landing door safety circuit 202 for all landing doors, or the landing doors on each side of the elevator could be monitored by two separate landing door safety circuits 202.

In the embodiment of FIG. 2 it is possible to differentiate between breaks occurring in the elevator car safety circuit 201 and in the landing door safety circuit 202. It is not possible to differentiate between breaks occurring in the individual landing door safety switches 207.

Figure 3:
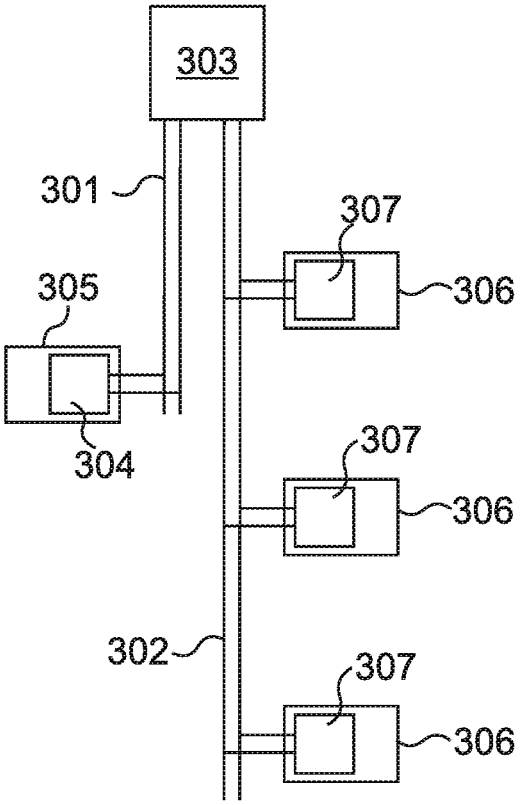
FIG. 3 is a block diagram of another exemplary embodiment according to the present disclosure.

FIG. 3 is a block diagram of another exemplary embodiment according to the present disclosure. In the embodiment of FIG. 3, there are two safety circuits, an elevator car door safety circuit 301 and a landing door safety circuit 302. In the embodiment of FIG. 3, each safety circuit 301, 302 is arranged as a serial bus.

It is possible to have more than one controller 303 in the embodiment of FIG. 3. If there are two or more controllers 303, they may be connected to another controlling device. This controlling device could be any elevator control and monitoring unit. The elevator car may move only when both the safety circuits 301, 302 have a closed status.

The elevator car door safety circuit 301 functions similarly to the embodiment in FIG. 2. The elevator car door safety circuit 301 comprises a safety switch 304, which monitors the open and closed position of an elevator car door lock 305. When the elevator car door lock 305 is in an open position, the safety switch 304 signals the open position, and the status of the safety circuit is open, creating a break in the safety circuit 301. When the elevator car door lock 305 is closed, the safety switch 304 signals the closed position, and the status of the safety circuit 301 is closed.

The landing door safety circuit 302 comprises a landing door safety switch 307 for each landing door lock 306. In the embodiment of FIG. 3, there are three landing doors, one in each landing (represented by the vertical positioning of the landing door locks 306 in FIG. 3). When a landing door lock 306 is in an open position, the corresponding safety switch 307 signals the open position of the door lock 306, and a break in the safety circuit 302 is created, through the open status of the safety circuit 302. Each landing door lock 306 and the corresponding safety switch 307 is monitored independently, and the controller 303 ascertains that a safety switch 307 signaling an open position and leading to a break in the landing door safety circuit 302 halts the elevator car movement, or causes the performance of the action according to the current disclosure, in case the characteristics of the break fulfil the conditions of the set of parameters.

Also in the embodiment of FIG. 3 it would be possible for each landing to have more than one door. In such a case, the landing door safety circuit 302 would be adjusted accordingly. It is further possible that a given elevator door has more than one door lock 306. In such a case, the door locks 306 can belong to the same safety circuit 302. Alternatively, a dedicated safety circuit may be constructed for them.

In the embodiment of FIG. 3 it is possible to assign a break in a safety circuit 301, 302 to a specific door lock. Thus is possible to record the landing level on which the break occurs.

One typical hardware configuration of a safety circuit is presented in FIG. 3. However, there are various known ways to implement a bus-based safety circuit, and the method, the elevator safety mode, the apparatus, the elevator safety system and the elevator may be implemented in using any of them.

Especially an embodiment as depicted in FIG. 3, or other similar bus-based arrangements, may be retrofitted into existing elevator installations, which previously may have relied on an electromechanical safety circuit. It is possible to replace an existing safety circuit with a serial bus-type safety circuit, or the two safety circuits may function in parallel. This may be used to create redundancy to the door safety arrangement.

When the method according to the current disclosure is implemented in the embodiments of FIG. 2 or FIG. 3, the controller 203, 303 may contain the set of parameters for comparing with the characteristics of a break detected in the safety circuit. Alternatively, the set of parameters may be stored in at least one other device. The controller 203, 303 may filter and transmit information from the safety circuits 201, 301, 202, 302 to one or more other devices for performing the comparison, or the controller 203, 303 may retrieve or receive the set of parameters from another device for performing the comparison. Further, the performance of the action may be done by the controller 203, 303 or by another device, or by the controller 203, 303 in cooperation with at least one other device.

It is also possible that the controller 203, 303 or another device analyzes the necessity of the performed action according to the present disclosure and possibly adjusts the set of parameters.

The invention claimed is:

1. A method for detecting an impact on an elevator door, said method comprising the steps of:
   detecting a break in an elevator door safety circuit;
   comparing characteristics of the break to a set of parameters; and
   performing an action when the characteristics of the break fulfil the conditions determined by the set of parameters,
   wherein the characteristics of the break comprise at least one of a duration of the break, a time lapsed after a previous break, or a position and a movement speed of an elevator car at the time of the occurrence of the break.

2. The method according to claim 1, further comprising the steps of:
   storing the characteristics of the break detected in the elevator door safety circuit;
   adjusting the set of parameters.

3. The method according to claim 2, wherein the action comprises initiation of an elevator safety mode and/or wherein the action comprises testing of at least one door-related parameter for evaluating elevator door functionality.

4. The method according to claim 2, wherein detecting the break comprises recording the landing level on which the break occurs.

5. The method according to claim 2, wherein the set of parameters comprises one or more threshold values for each of the characteristics of the break.

6. The method according to claim 2, wherein the elevator door safety circuit is an elevator car door safety circuit or an elevator landing door safety circuit.

7. The method according to claim 1, wherein the action comprises initiation of an elevator safety mode and/or wherein the action comprises testing of at least one door-related parameter for evaluating elevator door functionality.

8. The method according to claim 7, wherein detecting the break comprises recording the landing level on which the break occurs.

9. The method according to claim 7, wherein the set of parameters comprises one or more threshold values for each of the characteristics of the break.

10. The method according to claim 1, wherein detecting the break comprises recording the landing level on which the break occurs.

11. The method according to claim 10, wherein the set of parameters comprises one or more threshold values for each of the characteristics of the break.

12. The method according to claim 1, wherein the set of parameters comprises one or more threshold values for each of the characteristics of the break.

13. The method according to claim 12, wherein the position and/or movement speed of the elevator car is recorded and, in response to the elevator car passing the landing level on which the break occurs within a pre-determined time of the break and/or with a pre-determined speed, the break is disregarded.

14. The method according to claim 1, wherein the elevator door safety circuit is an elevator car door safety circuit or an elevator landing door safety circuit.

15. The method according to claim 1, wherein the method comprises sending a maintenance request if the action is performed.

16. An elevator safety mode, said elevator safety mode being initiated by detecting an impact by the method according to claim 1.

17. An apparatus for detecting an impact on an elevator door, wherein the apparatus is configured to perform the method according to claim 1.

18. An elevator door safety system, wherein the elevator safety system is configured to perform the method according to claim 1.

19. An elevator, wherein the elevator is configured to perform the method according to claim 1.

20. An elevator, wherein the elevator is configured to run the safety mode according to claim 16.

* * * * *